US007322796B2

(12) United States Patent
Pietraszkiewicz et al.

(10) Patent No.: US 7,322,796 B2
(45) Date of Patent: Jan. 29, 2008

(54) TURBINE VANE CONSTRUCTION

(75) Inventors: Edward F. Pietraszkiewicz, Southington, CT (US); Om Parkash Sharma, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 130 days.

(21) Appl. No.: 11/217,709

(22) Filed: Aug. 31, 2005

(65) Prior Publication Data

US 2007/0048135 A1 Mar. 1, 2007

(51) Int. Cl.
*F01D 9/04* (2006.01)
*F01D 5/22* (2006.01)

(52) U.S. Cl. ..... 416/193 A; 416/223 A; 416/224; 416/196 R; 29/889.22; 415/191

(58) Field of Classification Search ..... 29/889.22, 29/889.21, 889.7, 889.72, 889.721; 416/193 A, 416/212 A, 196 R, 224, 223 A
See application file for complete search history.

(56) References Cited

U.S. PATENT DOCUMENTS

| | | | | |
|---|---|---|---|---|
| 4,195,396 | A * | 4/1980 | Blazek | 415/191 |
| 4,827,588 | A * | 5/1989 | Meyer | 29/889.22 |
| 7,094,021 | B2 * | 8/2006 | Haubert | 416/193 A |
| 2004/0064930 | A1 * | 4/2004 | Gunn et al. | 29/889.721 |
| 2005/0076504 | A1 * | 4/2005 | Morrison et al. | 29/889.72 |

* cited by examiner

*Primary Examiner*—Richard A. Edgar
(74) *Attorney, Agent, or Firm*—Bachman & LaPointe

(57) ABSTRACT

A method for forming a component for use in a gas turbine engine, such as a turbine vane construction is provided. The method broadly comprises the steps of: forming a first aerodynamic structure having a first platform with a leading edge and a trailing edge, and an edge with an airfoil suction side structure; forming a second aerodynamic structure having a second platform with a leading edge and a trailing edge, and an first edge with an airfoil pressure side structure; and joining the two structures together so that the airfoil suction side structure mates with the airfoil pressure side structure to form an airfoil.

16 Claims, 3 Drawing Sheets

TURBINE VANE CONSTRUCTION

BACKGROUND OF THE INVENTION (1) Field of the Invention

The present invention relates to a method for forming a turbine vane and a turbine vane formed by the method of the present invention.

(2) Prior Art

Gas turbine engines have one or more turbine stages with a plurality of vanes. Turbine vanes 10 typically are cast structures having an airfoil 12 and a platform 14 as shown in FIG. 1. When assembled into an array, the turbine vanes 10 are mated along the platform edges 16 and 18. During assembly, platform parting gaps 20 may form between adjacent ones of the platform edges 16 and 18. Such gaps are undesirable and often require seals to prevent unwanted leaks.

A technique which eliminates such platform parting gaps is highly desirable.

SUMMARY OF THE INVENTION

Accordingly, the present invention provides a method for forming an array of gas turbine engine components, such as an array of turbine vanes, which eliminate platform parting gaps.

The present invention also provides a turbine engine component, such as a turbine blade, having a unique construction.

In accordance with the present invention, a method for forming a component for use in a gas turbine engine is provided. The method broadly comprises the steps of: forming a first aerodynamic structure having a first platform with a leading edge and a trailing edge, and an edge with an airfoil suction side structure; forming a second aerodynamic structure having a second platform with a leading edge and a trailing edge, and an first edge with an airfoil pressure side structure; and joining the two structures together so that the airfoil suction side structure mates with the airfoil pressure side structure to form an airfoil.

Further in accordance with the present invention, a structure for use in a gas turbine engine is provided. The structure broadly comprises: an airfoil having a leading edge, a trailing edge, a pressure side structure, and a suction side structure; and the airfoil being formed with a parting line that extends from the leading edge to the trailing edge so that the pressure side structure is on one side of the parting line and the suction side structure is on an opposed side of the parting line.

Still further in accordance with the present invention, a structure for use in forming an array of turbine engine components is provided. The structure broadly comprises: a platform having a leading edge and a trailing edge; an airfoil pressure side structure formed along a first side edge of the platform; and an airfoil suction side structure formed along a second side edge of the platform.

Yet further in accordance with the present invention, an array of turbine engine components formed by a plurality of structures joined together is provided. Each of the structures broadly comprises a platform having a leading edge and a trailing edge, an airfoil pressure side structure formed along a first side edge of the platform, and an airfoil suction side structure formed along a second side edge of the platform.

Other details of the turbine vane construction of the present invention, as well as other advantages and objects attendant thereto, are set forth in the following detailed description and the accompanying drawings wherein like reference numerals depict like elements.

DETAILED DESCRIPTION OF THE PREFERRED EMBODIMENT(S)

Figure 1:
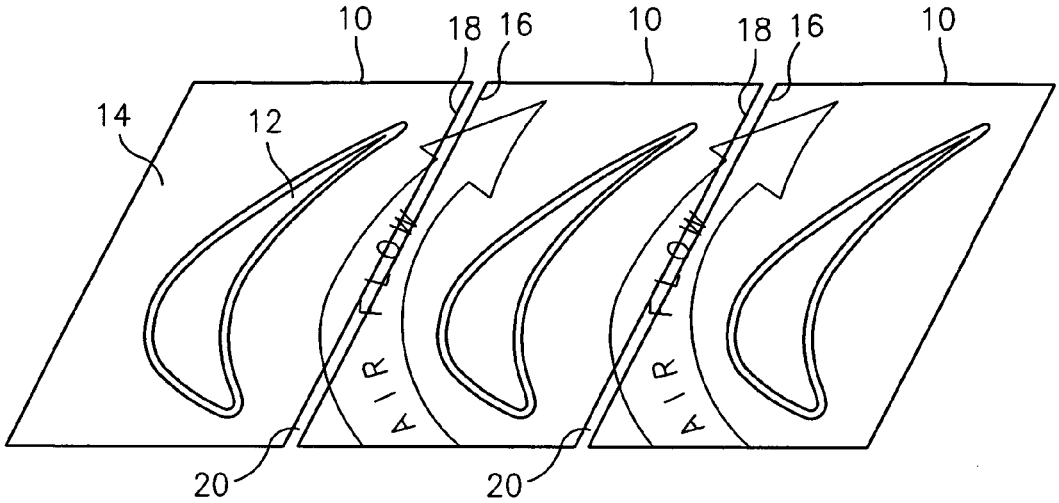
FIG. 1 (PRIOR ART)
FIG. 1 illustrates a turbine vane construction currently in use.
Figure 2:
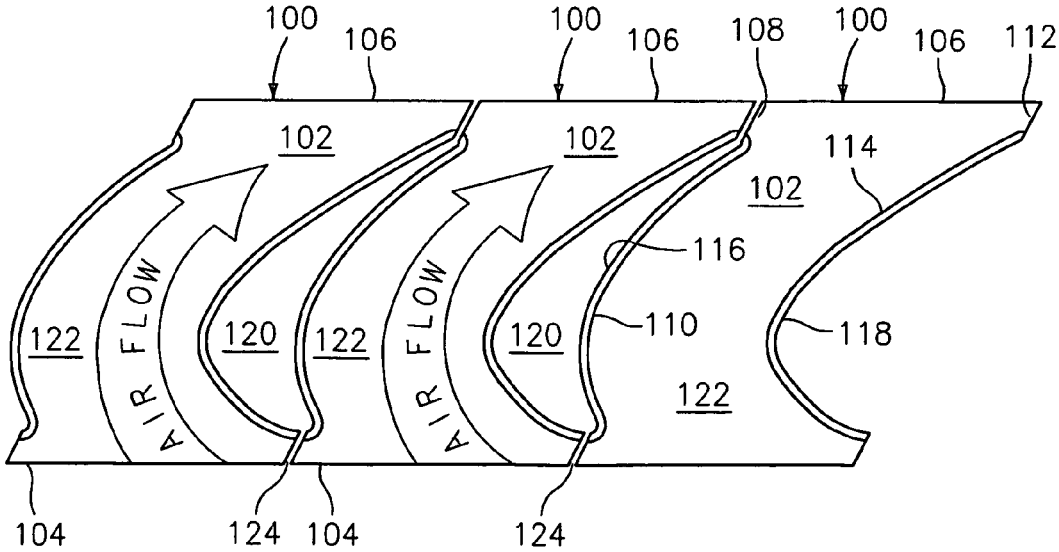
FIGS. 2 and 3 illustrate a turbine vane construction in accordance with the present invention.
Figure 3:
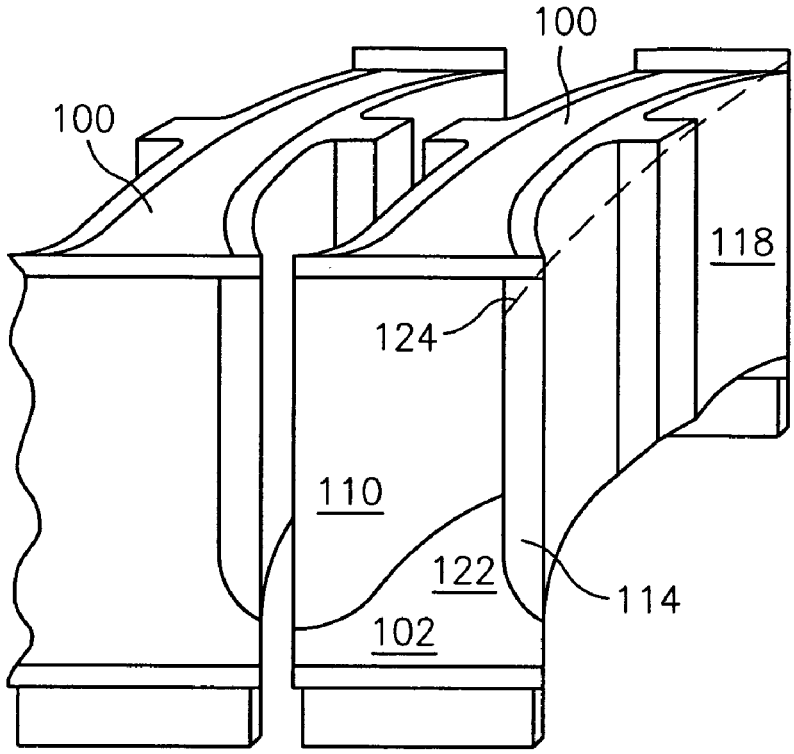

Referring now to the drawings, FIGS. 2 and 3 illustrate a plurality of structures 100 from which an array of turbine engine components can be formed. While the present invention will be discussed in the context of forming a turbine vane array, it should be recognized that the present invention can be used to form arrays of turbine and compressor blades as well as other gas turbine engine components.

As shown in FIGS. 2 and 3, each structure 100 has a platform portion 102 with a leading edge 104 and a trailing edge 106. Along a first edge 108 of the platform portion 102, there is a first vane half 110 in the form of an airfoil pressure side structure. Along a second edge 112 of the platform portion 102, there is a second vane half 114 in the form of an airfoil suction side structure. The exposed surface 116 of the first vane half 110 forms an interior surface when two of the structures 100 are placed adjacent each other and/or joined together. Similarly, the exposed surface 118 of the second vane half 114 is an interior surface when two of the structures 100 are placed adjacent each other and/or joined together. Each of the structures 100 may have an attachment portion (not shown) formed on an underside of the platform portion 102.

Each of the structures 100 is preferably a cast structure and may be formed using any suitable casting technique known in the art. While the structures 100 are preferably cast structures, they may also be machined structures if desired.

When adjacent ones of the structures 100 are placed together or joined together, airfoils 120 are formed. The structures 100 may be joined together using any suitable technique known in the art. Fluid passageways 122 extend between adjacent ones of the airfoils 120.

If desired, but not necessarily, the parting line 124 between the first vane half 110 and the second vane half 114 may be along the mean camber line of the airfoil 120.

Figure 4:
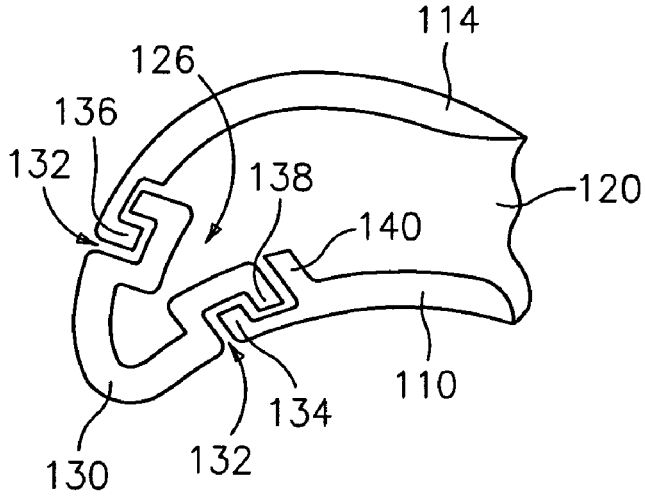
FIGS. 4 and 5 describe optional trailing edge and leading edge inserts.
Figure 5:
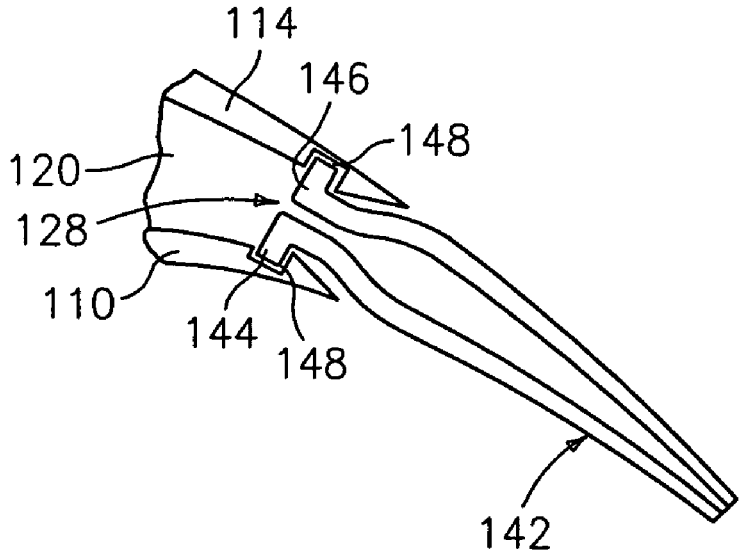

Referring now to FIGS. 4 and 5, when the vane halves 110 and 114 are placed or joined together, opening 126 is typically present at the leading edge of the airfoil 120 and opening 128 is typically present at the trailing edge of the airfoil 120. In order to provide a completely aerodynamic airfoil, a leading edge insert 130 may be used to close the opening 126. The leading edge insert 130 may be formed from any suitable metal or non-metallic material known in the art. If desired, the leading edge insert 130 may be formed from the same material as that forming the vane halves 110 and 114. The leading edge insert 130 may have a pair of grooves 132 for receiving a tab portion 134 on the vane half 110 and a tab portion 136 on the vane half 114. If desired, the grooves 132 may each have a rear wall 138 which abuts against a shoulder 140 on the interior surface 116 or 118. Still further, if desired, the tab portions 134 and 136 may each be physically joined such as by an adhesive, welding, etc. to a portion of a respective groove 132.

A trailing edge insert 142 may be used to close the opening 128. The trailing edge insert 142 may be formed from any suitable metallic or non-metallic material known in the art. If desired, the trailing edge insert 142 may be formed from the same material as the airfoil 120. The trailing edge insert 142 may be joined to the vane halves 110 and 114 respectively via a tongue and groove structure. The insert 142 may have a pair of tongues 144 at the mating edge 146. Each of the vane halves 110 and 114 may have a groove 148 into which one of the tongues 144 is placed. If desired, each tongue 144 may be physically joined to a portion of a respective groove 148 by an adhesive, a weldment, etc.

The leading edge and trailing edge inserts 130 and 142 may be of similar, or dissimilar materials such as ceramics, or detailed features cast separately.

In accordance with the present invention, a method for forming a component for use in a gas turbine engine, such as a turbine vane, comprises the steps of forming a first aerodynamic structure 110 having a first platform portion 102 with a leading edge 104 and a trailing edge 106, and an edge 112 with an airfoil suction side structure 114, forming a second aerodynamic structure 100 having a second platform portion 102 with a leading edge 104 and a trailing edge 106, and a first edge 108 with an airfoil pressure side structure 110, and joining the two structures 100 together so that the airfoil suction side structure 114 mates with the airfoil pressure side structure 110 to form an airfoil 120. The structures 110 and 114 may be joined together using any suitable technique known in the art and may be joined along the mean camber line of the airfoil 120. The leading and trailing edge inserts 130 and 142 are preferably added after the joining step.

One of the advantages of the method of the present invention is the elimination of platform parting gaps. Other advantages include a stepless platform portion 102 for better aerodynamic performance and elimination of a major source of parasitic leakage together with required feather seals.

Yet another advantage is that the mating faces, for the most part, are shifted to the leading and trailing edge of the airfoil 120. The gaps or openings 126 and 128 are a natural leak path and this is precisely where the cooling air is needed for temperature reduction. The leading edge mating also creates a desirable trench or opening 126.

Figure 6:
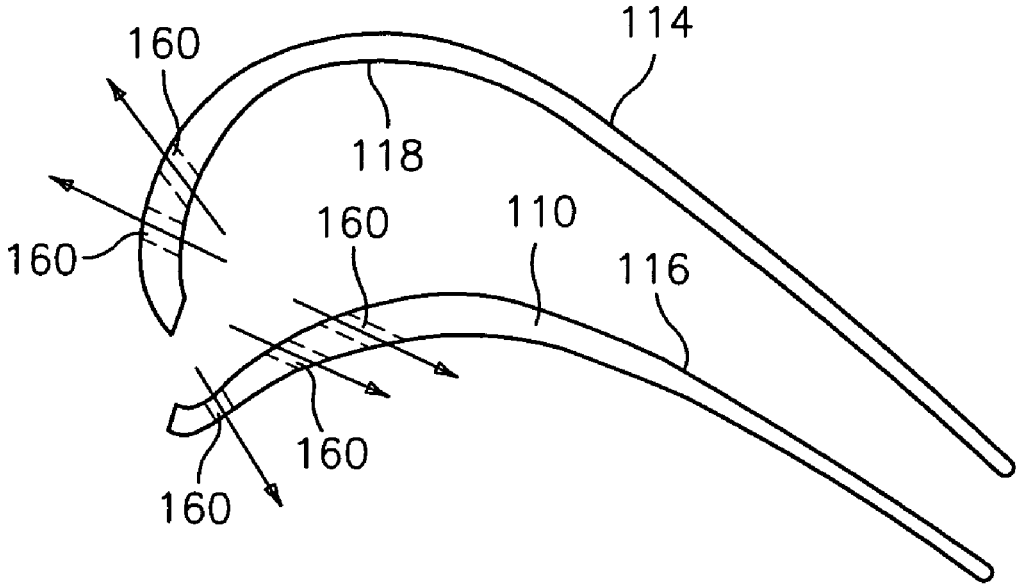
FIG. 6 illustrates a plurality of holes drilled in the turbine vane construction of the present invention.

As shown in FIG. 6, the method of the present invention also allows film holes 160 to be drilled from the inside of the exposed vane half 110 or 114 prior to the mold halves 110 and 114 being placed or joined together. As a result, film hole drilling becomes much easier since the holes can be drilled from the inside out. As a result, drilling and the eventual cooling flow may be in the same direction. Hole drilling from the inside out provides an ability to better optimize cooling flow through better correlation between the internal start of the hole and the external exit. This method also provides the ability to locate cooling holes precisely in between any internal trip strips in the cooling passageways, thereby improving local flow distribution and the resultant film effectiveness. The datums for hole drilling may be incorporated directly on a casting on an inner wall of the airfoil.

As an added benefit, baffles could be totally eliminated and replaced with conforming covers attached to one or more of the interior walls 116 and 118.

It is apparent that there has been provided in accordance with the present invention a turbine vane construction which fully satisfies the objects, means, and advantages set forth hereinbefore. While the present invention has been described in connection with specific embodiments thereof, other unforseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A method for forming a component for use in a gas turbine engine comprising the steps of:

forming a first aerodynamic structure having a first platform with a leading edge and a trailing edge, and an edge with an airfoil suction side structure;

forming a second aerodynamic structure having a second platform with a leading edge and a trailing edge, and a first edge with an airfoil pressure side structure;

wherein said forming steps comprise forming said first aerodynamic structure with an opposed edge having an airfoil pressure side structure and forming said second aerodynamic structure with an opposed edge having an airfoil suction side structure;

joining said two structures together so that said airfoil suction side structure mates with said airfoil pressure side structure to form an airfoil; and adding a leading edge insert after said joining step.

2. The method according to claim 1, wherein said joining step comprises joining said airfoil suction side structure with said airfoil pressure side structure along a mean camber line of said airfoil.

3. The method according to claim 1, wherein each of said forming steps comprises casting said respective structures with exposed internal surfaces for said airfoil pressure side structure and said airfoil suction side structure.

4. The method according to claim 1, further comprising drilling cooling holes in said airfoil pressure side and airfoil suction side structures prior to said joining step.

5. The method according to claim 4, wherein said drilling step comprises drilling said cooling holes from an internal surface to an external surface of said airfoil pressure side structure and from an internal surface to an external surface of said airfoil suction side structure.

6. The method according to claim 5, wherein said drilling step further comprises drilling said cooling holes in the same direction as intended cooling flow.

7. The method according to claim 1, further comprising the step of:

adding a trailing edge insert after said joining step.

8. The method according to claim 1, wherein said forming and joining steps form a turbine vane component.

9. A structure for use in a gas turbine engine comprising:

an airfoil having a leading edge, a trailing edge, a pressure side structure, and a suction side structure;

said airfoil being formed with a parting line that extends from said leading edge to said trailing edge so that said pressure side structure is on one side of said parting line and said suction side structure is on an opposed side of said parting line;

a first platform structure joined to said pressure side structure of said airfoil and a second platform surface joined to said suction side structure of said airfoil and said parting line extending along mating edges of said first and second platform structures; and a leading edge insert jointed to a leading edge portion of said pressure side structure and a leading edge portion of said suction side structure.

10. The structure according to claim 9, further comprising said pressure side structure and said suction side structure being internally joined together.

11. The structure according to claim 9, further comprising a plurality of drilled holes which extend outwardly from inner surfaces of said airfoil to outer surfaces of said airfoil.

12. The structure according to claim 9 further comprising:

a trailing edge insert joined to a trailing edge portion of said pressure side structure and a trailing edge portion of said suction side structure.

13. The structure according to claim 9, wherein said structure is a turbine vane.

14. An array of turbine engine components formed by a plurality of structures joined together, each of said structures comprising a platform having a leading edge and a trailing edge, an airfoil pressure side structure formed along a first side edge of said platform, and an airfoil suction side structure formed along a second side edge of said platform, adjacent ones of said airfoil pressure side structure and said airfoil suction side structure being joined together, a leading edge insert joined to a leading edge portion of each of said pressure side structure and said suction side structure, and a trailing edge insert joined to a trailing edge portion of each of said pressure side structure and said suction side structure.

15. The array of claim 14, further comprising said adjacent ones of said airfoil pressure side structure and said airfoil suction side structure being joined along a mean camber line of said airfoil.

16. The array of claim 14, wherein said array is a turbine blade array.

* * * * *